US007223947B2

(12) United States Patent
Valiyambath Krishnan et al.

(10) Patent No.: US 7,223,947 B2
(45) Date of Patent: May 29, 2007

(54) DOMESTIC APPLIANCE AND HEATING STRUCTURE FOR A DOMESTIC APPLIANCE

(75) Inventors: Mohankumar Valiyambath Krishnan, Singapore (SG); Kai Heng Kwok, Singapore (SG); Gerard Cnossen, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/566,553

(22) PCT Filed: Jul. 22, 2004

(86) PCT No.: PCT/IB2004/051280

§ 371 (c)(1),
(2), (4) Date: Jan. 27, 2006

(87) PCT Pub. No.: WO2005/011331
PCT Pub. Date: Feb. 3, 2005

(65) Prior Publication Data

US 2006/0186112 A1 Aug. 24, 2006

(30) Foreign Application Priority Data

Jul. 30, 2003 (EP) ..... 03102345

(51) Int. Cl.
*H05B 3/06* (2006.01)

(52) U.S. Cl. ..... 219/521; 219/483; 219/505; 219/497; 219/512

(58) Field of Classification Search ..... 219/483, 219/497, 505, 512, 521
See application file for complete search history.

(56) References Cited

U.S. PATENT DOCUMENTS

| | | | | |
|---|---|---|---|---|
| 4,246,468 | A * | 1/1981 | Horsma | 219/553 |
| 4,276,466 | A * | 6/1981 | Middleman et al. | 219/523 |
| 4,292,499 | A * | 9/1981 | Kleinschmidt et al. | 392/480 |
| 4,518,850 | A * | 5/1985 | Grasso | 219/505 |
| 5,021,634 | A * | 6/1991 | Santoro et al. | 219/241 |
| 5,396,047 | A * | 3/1995 | Schilling et al. | 219/448.11 |
| 5,471,035 | A * | 11/1995 | Holmes | 219/505 |
| 5,818,011 | A * | 10/1998 | Ito et al. | 219/257 |
| 6,005,228 | A * | 12/1999 | Dickens et al. | 219/483 |
| 6,713,729 | B2 * | 3/2004 | Takeo et al. | 219/485 |

FOREIGN PATENT DOCUMENTS

WO WO2004042132 A2 5/2004

* cited by examiner

*Primary Examiner*—Robin Evans
*Assistant Examiner*—L Fastovsky
(74) *Attorney, Agent, or Firm*—Adam L. Stroud; Russell Gross

(57) ABSTRACT

An electric heating structure of a domestic appliance includes at least one first electric heating track (23) having a positive temperature coefficient and at least one additional electric heating track (27, 28). A control structure (22, 25, 29) is provided for controlling electric power supply to said first and additional heating tracks (23, 27, 28) and is sensitive to the heating of said at least one first heating track (23) for switching on said at least one additional electric heating track (27, 28) in parallel and in addition to said at least one first heating track (23) when said at least one first heating track (23) has been heated to at least a predetermined extent.

11 Claims, 3 Drawing Sheets

DOMESTIC APPLIANCE AND HEATING STRUCTURE FOR A DOMESTIC APPLIANCE

TECHNICAL FIELD

This invention relates to an electric heating structure for a domestic appliance such as an iron, a (deep fat or other) frying pan, a water kettle or a grill and to a domestic appliance including such a heating structure.

BACKGROUND ART

Many electric heating structures of domestic appliances include a heating element with a positive temperature coefficient (PTC), such as a thick-film resistive heating element. In a PTC heating element, the electric resistance increases with the temperature.

A problem of such heaters is that, in operation, the heating power of the heating element reduces as its temperature rises. The increase of the electric resistance as the temperature rises causes a reduction of the current through the heating element, and accordingly of the rate at which electric energy is converted into heat by the heating element.

For instance, in silver based heating elements the electric resistance typically increases by at least 0.2% of the room temperature resistance per ° C. This results in a power drop of more than 50% when heating up from room temperature to an operating temperature of the heating element of 250° C. and more than 20% when heating to 100° C. In a heating structure that has for instance been designed for a maximum power consumption of 2000 W, in order to avoid exceeding the maximum power usually available for household use without causing safety fuses or circuit breakers to trip, the maximum power available at 250° C. is therefore less than 1000 W. The high temperature power reduction generally associated to heaters with PTC heating elements causes an increase of the time required for heating to the maximum temperature associated to the selected or pre-set temperature setting, which manifests itself in particular during re-heating such as occurs for instance in thermostatically controlled heaters. Alternatively or in addition, the reduction of the available amount of power at higher temperatures results in a reduction of the conversion rate of a process, such as for instance steam generation, driven by the heating element.

SUMMARY OF THE INVENTION

It is an object of the invention to reduce the power reduction at higher temperatures that occurs in heating structures equipped with a PTC heating element.

According to the present invention, this object is achieved by providing a heater according to claim 1. The invention may also be embodied in a domestic appliance according to claim 11.

By switching-on an additional heating track in parallel and in addition to the first heating track when at least the first heating track has been heated to at least a predetermined extent, additional heating power is provided when the electric power consumption by the first heating track has reduced sufficiently to allow power consumption by a further heating track without exceeding the allowable maximum power consumption.

Further aspects, effects and details of particular embodiments of the invention are set forth in the dependent claims.

MODES FOR CARRYING OUT THE INVENTION

Figure 1:
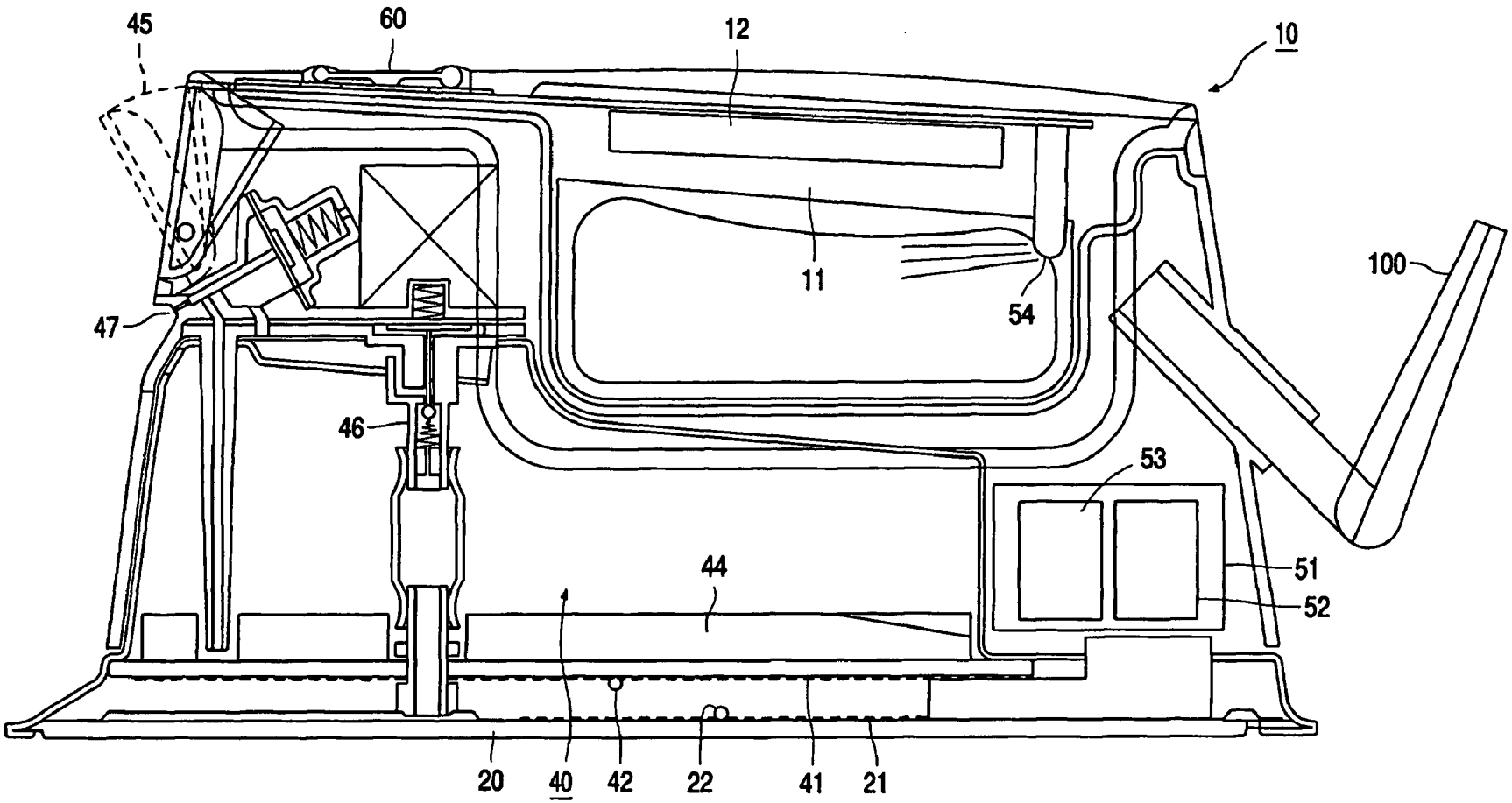
FIG. 1 is schematic representation in cross-sectional view along a vertical, longitudinal midplane of a domestic appliance according to the invention in the form of a steam iron equipped with a heater according to the invention.

FIG. 1 shows schematically a cross section of a steam iron according to the invention. The iron comprises a housing 10 to which a soleplate 20 is attached. The housing includes a handle portion 11. A steam generator 40, which at the same time serves as a water tank, a compartment 12 accommodating a control circuit, and a control panel 60, are arranged in the housing 10.

A first heating element 21 including first and second heating track-patterns, for instance of conducting film, and a temperature sensor 22, for example an NTC resistor, are located on the top side of the soleplate 20. A second heating element 41 also including first and second heating track-pattern, which may also be made of conducting film, is located on the bottom side of the steam generator 40. A temperature sensor 42 is disposed on the electrical insulation of the second heating element 41. The bottom of the steam generator 40 can be provided with a layer 44 of capillary material, which makes the entire surface of the bottom remain moist, even if the steam generator is almost empty and the bottom is standing at an angle or even vertically, as a measure against local overheating of the steam generator 40. A filling cap 45 is mounted to the housing 10 for closing off a filling passage communicating with a water reservoir of the steam generator 40. Also communicating with the water reservoir of the steam generator 40 are a steam valve 46, and a sprinkler 47. The filling cap 45 is shown as a collapsible filling cap, but a different design is, of course, also possible. The steam valve 46 is used to open and close the steam pipe between the steam generator 40 and the steam passages (not shown) in the soleplate, which open out into steam outlets at the bottom side thereof. The sprinkler 47, finally, serves for additional moistening of the articles being ironed.

The iron housing 10 also has a control circuit for controlling the temperature of the soleplate and the steam production in the steam generator 40. The control circuit is accommodated in the compartment 12 in the handle 11.

An isolation transformer 51, for example, is provided for the power supply to the control circuit, and arranged such that the control circuit has no direct contact with the mains voltage, and the control circuit can be driven by means of a low electrical voltage, which ensures greater safety. If there is adequate electrical insulation, the isolation transformer may be omitted. The iron is connected to the electricity mains by means of the flex 100. A hand presence detector 54, is included in the control circuit. The control panel 60 is also included in the control circuit and designed for the display of information which is useful to the user, such as an indication of the set temperature of the soleplate 20, and/or indications whether the soleplate has reached the set temperature, regarding the quantity of water in the steam generator etc. The control panel 60 also has switches for setting the temperature, for setting the degree of steam delivery, for operation of the sprinkler, and for causing the release of an additional steam surge.

Two relays 52 and 53 are disposed near the transformer 51, in order to switch on and off the two heating elements 21 and 41 in response to control signals from the control circuit for thermostatically controlling the two heating elements 21 and 41 in accordance with temperature signals received from the temperature sensors 22, 42.

Figure 2:
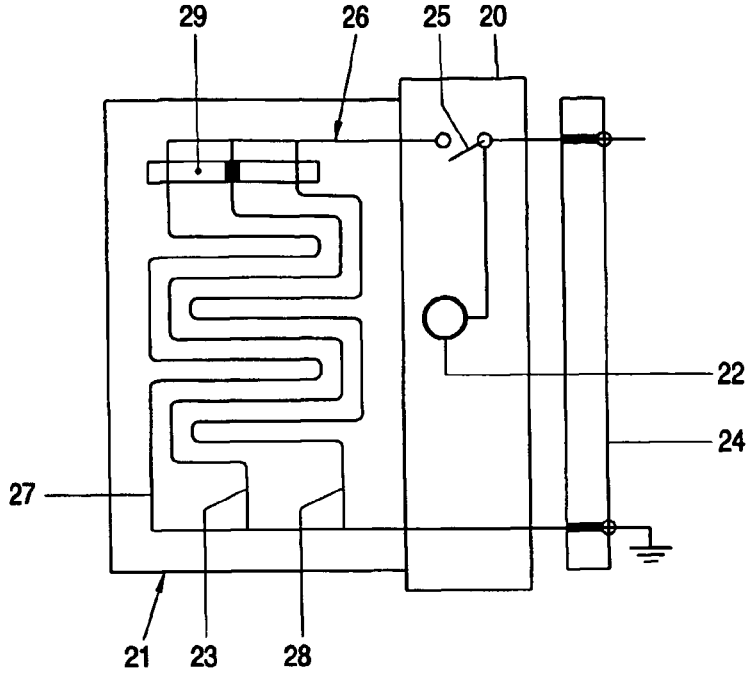
FIG. 2 is a schematic representation of a heating structure of the appliance according to FIG. 1.

In FIG. 2, a heating structure including the temperature sensor 22 is shown schematically. This heating structure for heating the soleplate 20 of the iron according to FIG. 1 includes a thick-film heating element 21.

The heating element 21 is provided with a first electric heating track 23 which has a positive temperature coefficient, as is typical for thick film heating tracks, especially silver based heating tracks, but also common for other heating tracks for electric heaters. The first electric heating track 23 is included in a circuit 26 connected to a contact plug 24 for connection to the mains and including a switch 25 that is operatively connected to the temperature sensor 22 (for instance an adjustable bimetal or a thermistor) for closing the switch 25 if the temperature of the soleplate 20 is below a switch-on temperature and opening the switch 25 if the temperature of the soleplate 20 reaches a switch-off temperature above the switch-on temperature.

The heating element 21 further includes a second electric heating track 27 and a third electric heating track 28, both included in the same circuit 26 in parallel to each other and to the first heating track 23.

In addition to the switch 25 controlled by a temperature signal from the temperature sensor 22, the control structure for controlling electric power supply to the heating tracks 23, 27, 28, further includes a control element 29, sensitive to the heating of the first heating track 23 and for switching-on the second and third electric heating tracks 27, 28 in parallel and in addition to said first heating track when the first heating track has been heated to a predetermined extent.

According to the present example, the control elements 29 is sensitive to temperature of the first heating track 23 for carrying out the switching-on of the second and third heating tracks 27, 28 in response to a sensed temperature above a predetermined temperature.

Figure 3:
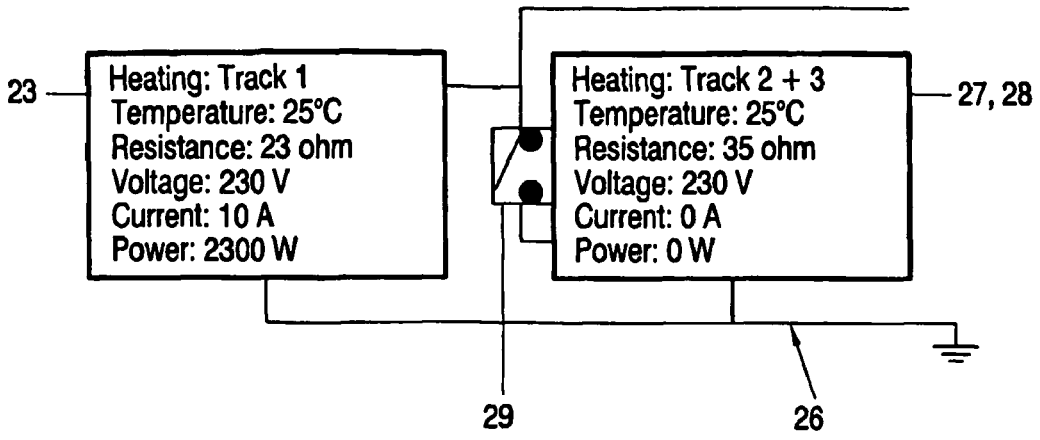
FIGS. 3-5 illustrate successive stages of operation of a heating structure according to FIG. 2.
Figure 4:
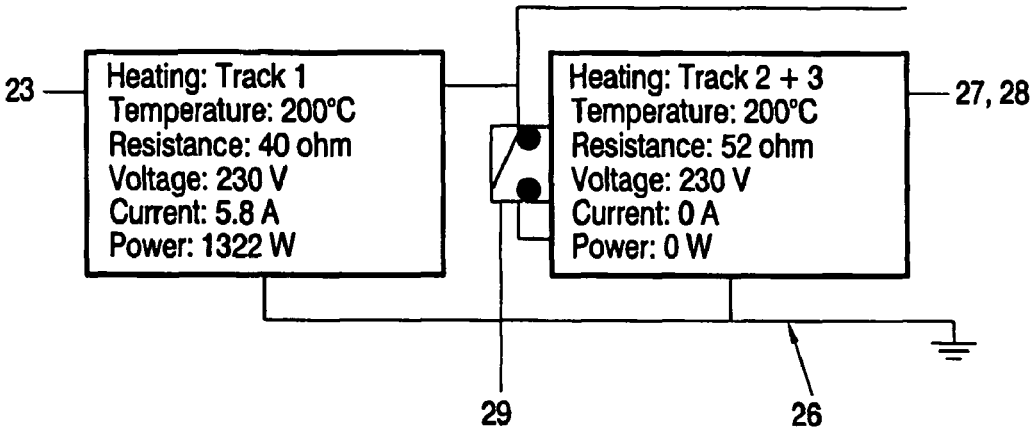
Figure 5:
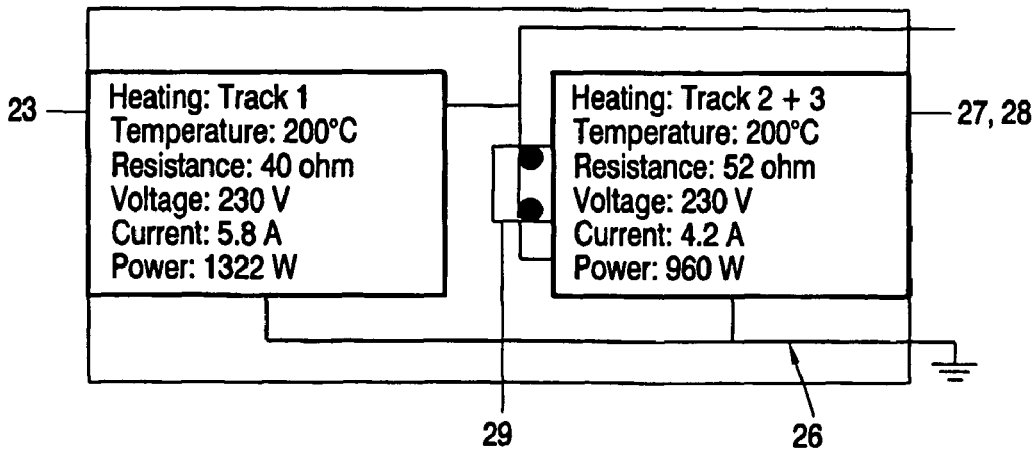

The operation of the heating structure according to FIG. 2, while the thermostatic control switch 25 is closed is illustrated by FIGS. 3-5. In FIG. 3, the situation at the time of cold start-up in an ambient room temperature of 25° C. is represented. The first heating track 23 has a resistance of 23 Ohm and at a voltage of 230 V; this results in a current of 10 A and, accordingly, a heating power of 2300 W. A current of 10 A is generally the maximum power that can reliably be drawn from normal domestic wall outlets without causing safety fuses or switches of the domestic power network to trip. Accordingly, the second and third heating tracks 27, 28, which have a combined resistance of 35 Ohm at the ambient temperature, are switched off during start-up from cold.

Figure 6:
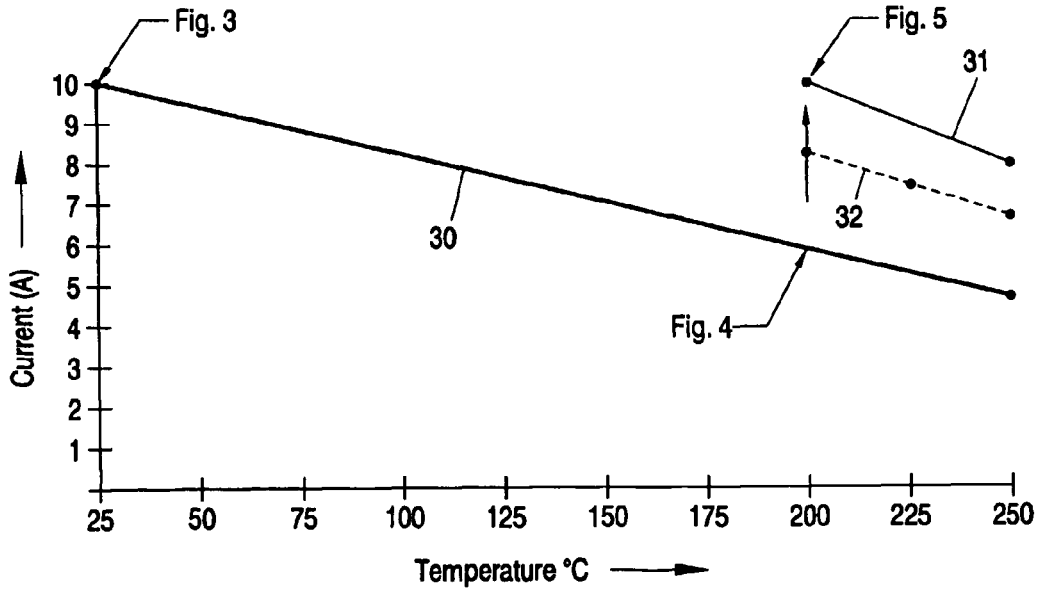
FIG. 6 is a graph showing electric current consumption of some examples of heating structures according to the invention.

The situation in FIG. 3 is accordingly indicated in the graph in FIG. 6. As can be seen in FIG. 6, line 30, which represents the current through the first heating track 23, decreases at a rate of about 0.02 A/° C. (i.e. about 0.2% of the current at 25° C. per ° C.).

FIG. 4 represents the situation once the first heating track 23 has reached a temperature of 200° C. and is also indicated in FIG. 6. The resistance of the first track 23 has increased to 40 Ohm so that the current has decreased to 5.8 A and the heating power has decreased to 1322 W. It is observed that the present invention may also be advantageous if the heating tracks have lower PTC values, for instance as low as 0.05% of the current at 25° C. per ° C.

Meanwhile, because the second and third heating tracks 27, 28 are mounted to the same thermal conductor as the first heating track 23 and thereby thermally coupled to the first heating track 23, the temperature of the switched-off second and third tracks 27, 28 has increased with the temperature of the first heating track 23, so that these tracks have also reached a temperature of 200° C. The combined electric resistance of the second and third tracks 27, 28 has thereby risen to 52 Ohm.

Then as represented by FIG. 5, the control element 29 switches-on the second and third heating tracks 27, 28. This causes an additional current of 2.1 A through each of the second and third heating tracks 27, 28, adding a current of 4.2 A to the current of 5.8 A through the first heating track 23. Accordingly, the total current through the heating structure is brought back to 10 A as also appears from the graph in FIG. 6.

If the temperature of the heating tracks 23, 27, 28 continues to rise to 250° C., the resistance of the tracks will continue to rise causing the total current to decrease again to 7.7 A at 250° C. (line 31). In another embodiment, partial compensation for such a renewed decrease of the heating power is achieved by providing control elements that cause the third heating track 28 to be switched on in response to a predetermined sensed temperature of at least one of the switched-on heating tracks 23, 27 that is higher than the sensed temperature in response to which the second heating track 27 is caused to be switched-on. The second heating track 27 may for instance have a resistance of 52 Ohm at 200° C. so that, at 200° C. , the heating power is again 2300 W. The third heating track may be added at 225° C. to add 1.15 A to again bring the total heating power to 2300 W by adding further heating power when the electric resistance of the first and second heating tracks 23, 27 has decreased after the second heating track was switched on in addition to the first heating track 23.

According to the present example, the heating tracks 23, 27, 28 are thermally connected to each other such that, in operation, the second and third heating tracks 27, 28 are heated by the first heating track 23. Furthermore, the sum of the electric resistance of the first heating track 23 when in condition for switch-on of the second and/or third heating track or tracks 27, 28 and of the electric resistance at room temperature of the track or tracks 27, 28 to be switched-on, is smaller than the electric resistance at room temperature of the first heating track 23. Because the second and third heating tracks 27, 28 are not switched-on before having been heated by the first heating track 23, it is nevertheless ensured that, in operation, the combined resistance of the heating tracks 23, 27, 28 does not drop below the initial resistance of the first heating track 23 when the second and third heating tracks 27, 28 are switched-on. Preferably, the heating track or tracks to be switched-on in addition to the first heating track are dimensioned such that the combined power consumption of all active heating tracks just after switch-on of the or each additional heating track is about equal to the initial heating power of the first heating track at room temperature. However, a margin (for instance up to about 25-50% of the power decrease in the active heating tracks to be compensated) may be applied, for instance for safety reasons or in view of available heating tracks or modular design to avoid an increase in the variety of parts used.

The effect of dimensioning the heating tracks such that the tracks to be switched-on bring the power back to the original level while in a condition pre-heated by the already active heating tracks is best illustrated by FIG. 6. If the second and third heating tracks 27, 28 would have been designed to have a combined resistance of 52 Ohm at room temperature, the resistance at 200° C. would have been 77 Ohm, so that the current through the second and third heating tracks at 200° C. would only be 2.4 A and drop to 1.9 A at 250° C. (see dashed line 32) instead of to 3.3 A at 250° C. as in the present example.

The switching-on of additional heating tracks in response to the active heating track being heated can be applied with particular advantage in appliances in which the first heating track is arranged for heating a medium and wherein said second heating track is arranged for heating the same medium. In particular in the temperature range of thermostatic temperature control, this provides a particularly fast reheating of the heated medium in response to heat withdrawal. Examples of such situations are the positioning of an iron on humid cloth or the feeding of cold or even frozen food to a deep fat fryer. Furthermore, if the heating tracks heat the same medium, it can be ensured relatively easily that the heating tracks to be switched-on at higher temperature are heated by the active heating tracks, so that these heating tracks may be dimensioned for compensating the entire power decrease of the active heating track or tracks at an elevated temperature without causing an undue risk of a too high current through the heating structure.

However, to avoid a current through the heating structure higher than the current at cold-start-up, it is preferred that the combined electric resistance of the heating tracks when the heating structure is in condition for switch-on of an additional heating track is equal to or larger than the electric resistance of the active heating track or tracks at room temperature.

To avoid that at any temperature, the current through the heating structure is higher than the current at cold-start-up, it is preferred that the sum of the electric resistance of, firstly, the active heating track or tracks when the heating structure is in condition for switch-on of one or more further heating tracks and, secondly, the electric resistance at room temperature of the heating track or tracks to be switched-on is equal to or larger than the electric resistance of the active heating track at room temperature. This is of particular interest if the further heating track or tracks that are to be switched-on in addition to one or more active heating tracks are not reliably heated by the active heating tracks.

For instance, in an iron with a steam generator as shown in FIG. 1, the first heating track that is switched-on first may be formed by the heater 41 of the steam generator and the additional heating track that is switched-on only if the first heating track is above a predetermined temperature may be formed by the heater 21 for heating the soleplate 20. This allows to have a steam iron of which the heating structure has a combined power at room temperature that is higher than would be allowable if all heating tracks could be active simultaneously while at room temperature, but which nevertheless allows to heat the soleplate while the heating track for generating steam is active without exceeding the maximum allowable electric power consumption rate, because the heater 21 for heating the soleplate 20 is switched-on only if the temperature of the heating track or tracks 41 of the steam generator is above a suitably set switch-on temperature (for instance 130 to 200° C.). For switching-on one or more further heating tracks 27, 28 in response to the temperature of the active (first) heating track or tracks, the control element 29 may for instance be provided in the form of a bimetallic temperature switch sensitive to temperature of the first heating track 23.

Another possibility is to provide the control element 29 in the form of a negative temperature coefficient (NTC) resistance, sensitive to temperature of the first heating track 23. In such a control element, a small current may also be allowed to pass through the further heating tracks before the switch-on temperature is reached and even at room temperature. The current at room temperature may for instance be a few tenth of a percent or up to a few percent of the current at 200° C. In most NTC-resistances, the resistance decreases exponentially with temperature. A smooth switch-on of the additional heating tracks provides the advantage that the further increase of the resistance of the active heating tracks as temperature rises may be taken into account when dimensioning the heating tracks without allowing the maximum power consumption rate to be exceeded.

Within the framework of the present invention many other embodiments than those, which have been described above by way of example, are conceivable. For instance, in the previous examples, the further heating track or tracks have been switched on in response to the sensed temperature of at least the active heating track or tracks. However, it is also possible to provide that the control structure switches-on additional heating tracks in response to other phenomena than the sensed temperature that are normally associated to the temperature of the active heating tracks.

For instance, the control element 29 may be sensitive to electric current through the first heating track 23 for carrying out the switching-on of the second and third heating track 27, 28 in response to at least current through the first heating track 23 being below a predetermined current.

The control element 29 may also include a timer and be adapted for carrying out the switching-on of the second and third heating track 27, 28 in response to at least expiration of a predetermined duration of time after switching-on the first heating track 23, for instance if the purpose of the switching-on of additional heating tracks, while ensuring that maximum allowable power consumption is not exceeded at any time, is mainly to improve the responsiveness to heat withdrawal in use while the time to heat up from cold is relatively unimportant.

The invention claimed is:

1. An electric heating structure for a domestic appliance including:

at least one first electric heating track (23) having a positive temperature coefficient;

at least one additional electric heating track (27, 28);

a control structure (22, 25, 29) for controlling electric power supply to said first and additional heating tracks (23, 27, 28), sensitive to the heating of said at least one first heating track (23) and for switching-on said at least one additional electric heating track (27, 28) in parallel and in addition to said at least one first heating track (23) when said at least one first heating track (23) has been heated to at least a predetermined extent.

2. A heating structure according to claim 1, wherein said control structure (22, 25, 29) is sensitive to temperature of said at least one first heating track (23) for carrying out said switching-on of said at least one additional heating track (27, 28) in response to at least a sensed temperature above a predetermined temperature.

3. A heating structure according to claim 2, wherein said control structure (22, 25, 29) includes a bimetallic temperature switch (29) sensitive to temperature of said at least one first heating track (23).

4. A heating structure according to claim 2, wherein said control structure (22, 25, 29) includes a negative temperature coefficient resistance (29), sensitive to temperature of said at least one first heating track (23).

5. A heating structure according to claim 1, wherein said control structure (22, 25, 29) includes a sensing unit (29) sensitive to electric current through said at least one first heating track (23) and is adapted for carrying out said switching-on of said at least one additional heating track (27, 28) in response to at least current through said at least one first heating track (23) being below a predetermined current.

6. A heating structure according to claim 1, wherein said control structure (22, 25, 29) includes a timer (29) and is adapted for carrying out said switching-on of said at least one additional heating track (27, 28) in response to at least expiration of a predetermined duration of time after switching-on said at least one first heating track (23).

7. A heating structure according to claim 1, wherein said at least one first and additional heating tracks (23, 27, 28) are thermally connected to each other such that, in operation, said at least one additional heating track (27, 28) is heated by said at least one first heating track (23) to at least some extent, and wherein the combined electric resistance of said at least one first heating track (23) in condition for switching-on said at least one additional heating track (27, 28) and of at least said at least one additional heating track (27, 28) at room temperature is smaller than the electric resistance of said at least one first heating track (23) at room temperature.

8. A heating structure according to claim 7, wherein, in operation, the combined electric resistance of said heating tracks (23, 27, 28) when in condition for switch-on of said at least one additional heating track (27, 28) is equal to or larger than the electric resistance of said at least one first heating track (23) at room temperature.

9. A heating structure according to claim 1, wherein the combined electric resistance of said at least one first heating track (23) in condition for switching-on of said at least one additional heating track (27, 28) and of said at least one additional heating track (27, 28) at room temperature is equal to or larger than the electric resistance of said at least one first heating track (23) at room temperature.

10. A heating structure according to claim 1, wherein said at least one first heating track (23) is arranged for heating a medium and wherein said at least one additional heating track (27, 28) is arranged for heating the same medium.

11. A domestic appliance for heating an object or a medium including at least one heating structure according to any one of the preceding claims arranged for temperature exchange with the medium or object to be heated.

* * * * *